US010202870B2

(12) United States Patent
Monteiro et al.

(10) Patent No.: US 10,202,870 B2
(45) Date of Patent: Feb. 12, 2019

(54) FLANGE RELIEF FOR SPLIT CASING

(71) Applicant: United Technologies Corporation, Farmington, CT (US)

(72) Inventors: Crystal Monteiro, Portland, CT (US); Stephen A. Sarcich, Vernon, CT (US); Mark R. Wood, Middletown, CT (US)

(73) Assignee: United Technologies Corporation, Farmington, CT (US)

( * ) Notice: Subject to any disclaimer, the term of this patent is extended or adjusted under 35 U.S.C. 154(b) by 345 days.

(21) Appl. No.: 15/034,344

(22) PCT Filed: Nov. 6, 2014

(86) PCT No.: PCT/US2014/064261

§ 371 (c)(1),
(2) Date: May 4, 2016

(87) PCT Pub. No.: WO2015/116277

PCT Pub. Date: Aug. 6, 2015

(65) Prior Publication Data

US 2016/0281541 A1 Sep. 29, 2016

Related U.S. Application Data

(60) Provisional application No. 61/904,158, filed on Nov. 14, 2013.

(51) Int. Cl.
*F01D 25/26* (2006.01)
*F01D 25/24* (2006.01)

(52) U.S. Cl.
CPC ..... *F01D 25/265* (2013.01); *F01D 25/243* (2013.01); *F05D 2220/32* (2013.01); *F05D 2230/60* (2013.01); *F05D 2250/71* (2013.01)

(58) Field of Classification Search
CPC .. F01D 25/265; F01D 25/243; F05D 2250/71; F05D 2230/60; F05D 2220/32
See application file for complete search history.

(56) References Cited

U.S. PATENT DOCUMENTS

| | | | | |
|---|---|---|---|---|
| 3,592,557 | A | 7/1971 | Haas et al. | |
| 4,502,809 | A | 3/1985 | Geary | |
| 4,599,147 | A | 7/1986 | Thompson | |
| 4,762,462 | A | 8/1988 | Lardellier | |
| 5,131,811 | A | 7/1992 | Johnson | |
| 5,224,824 | A | 7/1993 | Eng | |
| 5,354,174 | A | 10/1994 | Balkcum et al. | |
| 5,503,490 | A * | 4/1996 | Melton | F01D 25/243 403/28 |

(Continued)

OTHER PUBLICATIONS

The International Preliminary Report on Patentability for PCT Application No. PCT/US2014/064261, dated May 26, 2016.

(Continued)

*Primary Examiner* — Eldon Brockman
(74) *Attorney, Agent, or Firm* — Carlson, Gaskey & Olds, P.C.

(57) ABSTRACT

A split case for a gas turbine engine includes multiple split case portions defining a turbine engine case section. Each of the split case portions has a first and second axially aligned split flange and a circumferential flange on an axial end. Each of the circumferential flanges includes a thermal expansion relief void.

19 Claims, 3 Drawing Sheets

(56) References Cited

U.S. PATENT DOCUMENTS

| | | | | |
|---|---|---|---|---|
| 5,551,790 | A * | 9/1996 | Melton | F01D 25/243 403/28 |
| 5,593,276 | A * | 1/1997 | Proctor | F01D 11/18 415/138 |
| 5,605,438 | A | 2/1997 | Burdgick et al. | |
| 6,352,404 | B1 * | 3/2002 | Czachor | F01D 25/243 415/116 |
| 6,896,491 | B2 | 5/2005 | Trubnikov et al. | |
| 6,941,633 | B2 * | 9/2005 | Brooks | B25B 27/16 29/239 |
| 2003/0131603 | A1 | 7/2003 | Bolender et al. | |
| 2004/0223846 | A1 | 11/2004 | Taylor et al. | |
| 2005/0034461 | A1 * | 2/2005 | McMasters | F23R 3/10 60/752 |
| 2005/0044685 | A1 * | 3/2005 | Brooks | B25B 27/16 29/426.5 |
| 2006/0263208 | A1 | 11/2006 | Stone et al. | |
| 2009/0185894 | A1 | 7/2009 | Kneeland et al. | |
| 2010/0196149 | A1 | 8/2010 | Beaulieu | |

OTHER PUBLICATIONS

Supplementary European Search Report for Application No. 14881097.1 dated Dec. 19, 2016.

International Search Report and Written Opinion for Application No. PCT/US2014/064261 dated Aug. 19, 2015.

* cited by examiner

FLANGE RELIEF FOR SPLIT CASING

CROSS-REFERENCE TO RELATED APPLICATION

This application claims priority to U.S. Provisional Application No. 61/904,158 filed on Nov. 14, 2013.

TECHNICAL FIELD

The present disclosure relates generally to turbine engine cases, and more specifically to a split case for a turbine engine.

BACKGROUND OF THE INVENTION

Gas turbine engines include compressor, combustor and turbine sections that operate cooperatively to rotate a shaft. In an aircraft engine, the shaft rotation operates in conjunction with other engine systems, such as a fan, to generate thrust. Each of the turbine engine sections is encapsulated by a cylindrical, or approximately cylindrical, case structure that provides structural support for the components within the case, as well as protecting the components.

One type of case commonly used for gas turbine engines is a split case. A split case includes two or more partial case components that are combined to form a full case. Each partial case component includes a pair of axially aligned flanges (referred to as split flanges). The split flanges of each partial case component are connected to split flanges of at least one other partial case component to form a complete split case. In some examples, a complete split case includes two partial case components. Alternate designs can include three or more case components. The complete split case includes a circumferential flange on each axial end. The circumferential flanges connect the case to an adjacent engine structure, such as a fan section or another case section.

Due to the nature of split cases, split cases frequently have a condition in which assembly fits combined with thermal growth, cause separation in the split flange at an associated circumferential flange. The separation causes deflection in adjacent hardware, such as an adjacent gas turbine engine structure. The deflection, in turn, causes a corresponding high stress region in the adjacent gas turbine engine structure.

SUMMARY OF THE INVENTION

A split case for a gas turbine engine according to an exemplary embodiment of this disclosure, among other possible things includes a plurality of split case portions defining a turbine engine case section, each of the split case portions in the plurality of split case portions includes a first split flange and a second split flange, each of the first split flange and the second split flange are axially aligned, each of the first split flange and the second split flange is configured to mechanically connect to another split case portion in the plurality of split case portions defining the turbine engine case section, each of the split case portions in the plurality of split case portions includes a circumferential flange portion located at an axial end, the circumferential flange portion is configured to connect the turbine engine case section to an adjacent turbine engine component, and each of the circumferential flanges including a thermal expansion relief void positioned at the split flanges.

In a further embodiment of the foregoing split case, each of the relief voids extends partially into the circumferential flange, such that a radially aligned groove in the circumferential flange is defined.

In a further embodiment of the foregoing split case, the radially aligned groove extends a full radial length of the circumferential flange.

In a further embodiment of the foregoing split case, the radially aligned groove extends a partial radial length of the circumferential flange from a radially outward edge of the circumferential flange thereby defining a radially inward wall of the relief void.

In a further embodiment of the foregoing split case, the radially inward wall of the relief void includes an axially inward edge connected to a back portion of the circumferential flange, and an axially outward edge connected to an axial end of the circumferential flange.

In a further embodiment of the foregoing split case, the axially inward edge includes a curvature.

In a further embodiment of the foregoing split case, the axially outward edge includes a curvature.

In a further embodiment of the foregoing split case, the axially inward edge includes a chamfer.

In a further embodiment of the foregoing split case, the axially outward edge includes a chamfer.

A gas turbine engine according to an exemplary embodiment of this disclosure, includes a split case structure configured to circumferentially surround at least a portion of the gas turbine engine, the split case structure includes, a plurality of split case portions defining the split case structure, each of the split case portions in the plurality of split case portions includes a first split flange and a second split flange, each of the first split flange and the second split flange are axially aligned, each of the first split flange and the second split flange is configured to mechanically connect to another of the plurality of split case portions in the plurality of split case portions defining the split case structure, each of the split case portions in the plurality of split case portions including a circumferential flange portion located at an axial end, the circumferential flange portion is configured to connect the turbine engine case section to an adjacent turbine engine component, and each of the circumferential flanges including a thermal expansion relief void positioned at the split flanges.

A further embodiment of the foregoing turbine engine includes at least a second case structure, the split case structure is mechanically connected to the second case structure via the circumferential flanges.

A further embodiment of the foregoing turbine engine includes a material layer connecting the circumferential flanges to a circumferential flange of the second case structure.

In a further embodiment of the foregoing turbine engine, each of the relief voids is configured to reduce deflection in the second case structure due to thermal expansion of the split case structure.

In a further embodiment of the foregoing turbine engine, each of the relief voids extends partially into the circumferential flange, such that a radially aligned groove in the circumferential flange is defined.

In a further embodiment of the foregoing turbine engine, the radially aligned groove extends an entire radial length of the circumferential flange.

In a further embodiment of the foregoing turbine engine, the radially aligned groove extends a partial radial length of the circumferential flange from a radially outward edge of the circumferential flange thereby defining a radially inward wall of the relief void.

In a further embodiment of the foregoing turbine engine, the radially inward wall of the relief void includes an axially inward edge connected a back portion of the circumferential flange, and an axially outward edge connected to an axial end of the split case portion.

A method according to an exemplary embodiment of this disclosure, includes reducing deflection in an adjacent turbine engine case component caused by thermal growth of a split case including, disposing at least one relief void in a circumferential flange of the split case, the at least one relief void is positioned circumferentially at a split flange joint of said circumferential flange.

A further embodiment of the foregoing method includes disposing at least one relief void in the circumferential flange of the split case in includes disposing a radially aligned groove in the circumferential flange, the radially aligned groove extending a partial radial length of the circumferential flange from a radially outward edge of the circumferential flange, thereby defining a radially inward wall of the relief void, and the radially inward wall of the relief void is defined by an axially inward edge connected a back portion of the circumferential flange and an axially outward edge connected to an axial end of the split case portion.

The foregoing features and elements may be combined in any combination without exclusivity, unless expressly indicated otherwise.

These and other features of the present invention can be best understood from the following specification and drawings, the following of which is a brief description.

DETAILED DESCRIPTION OF AN EMBODIMENT

Figure 1:
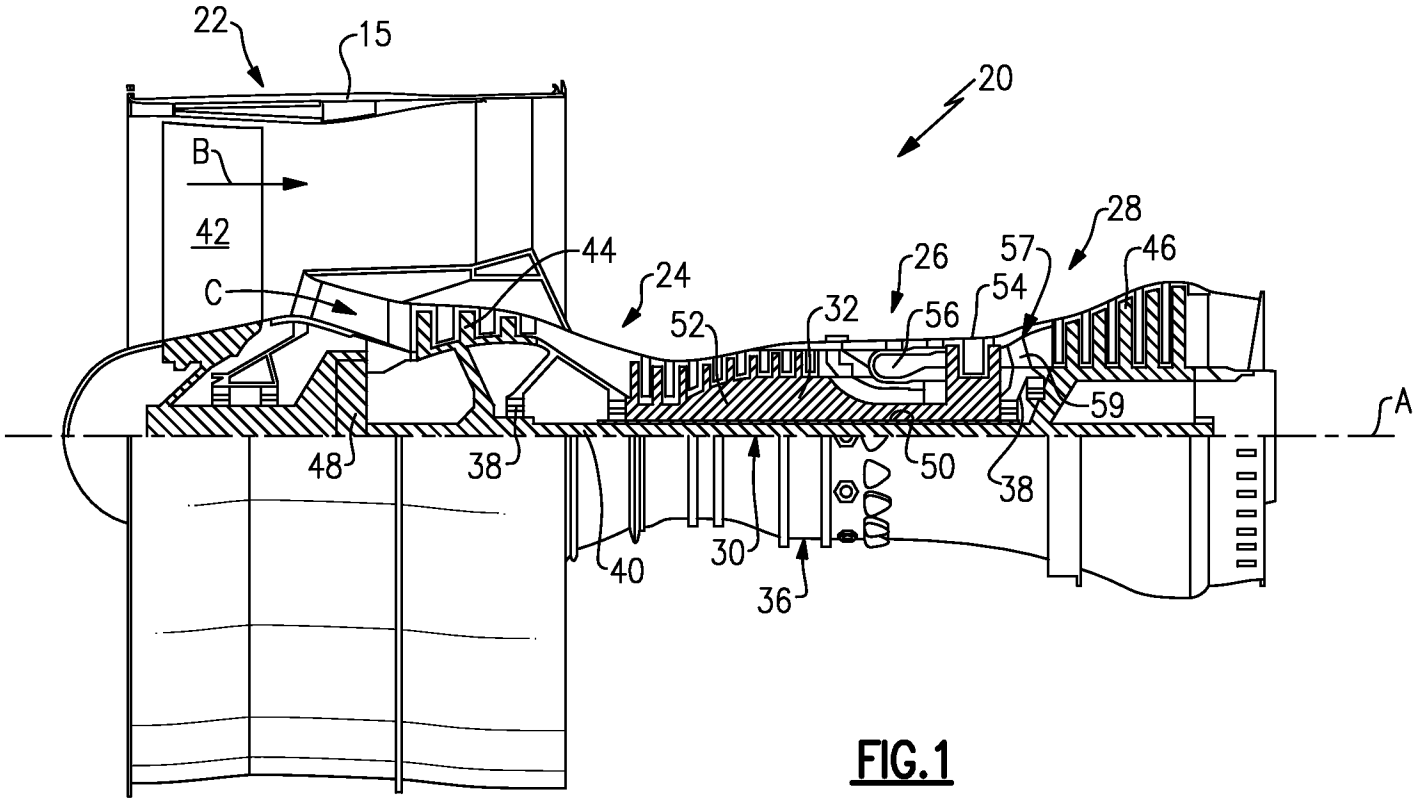
FIG. 1 schematically illustrates a gas turbine engine, according to an embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ)]^{0.5}$. The "Low corrected fan tip speed" as disclosed herein according to one non-limiting embodiment is less than about 1150 ft/second.

Figure 2:
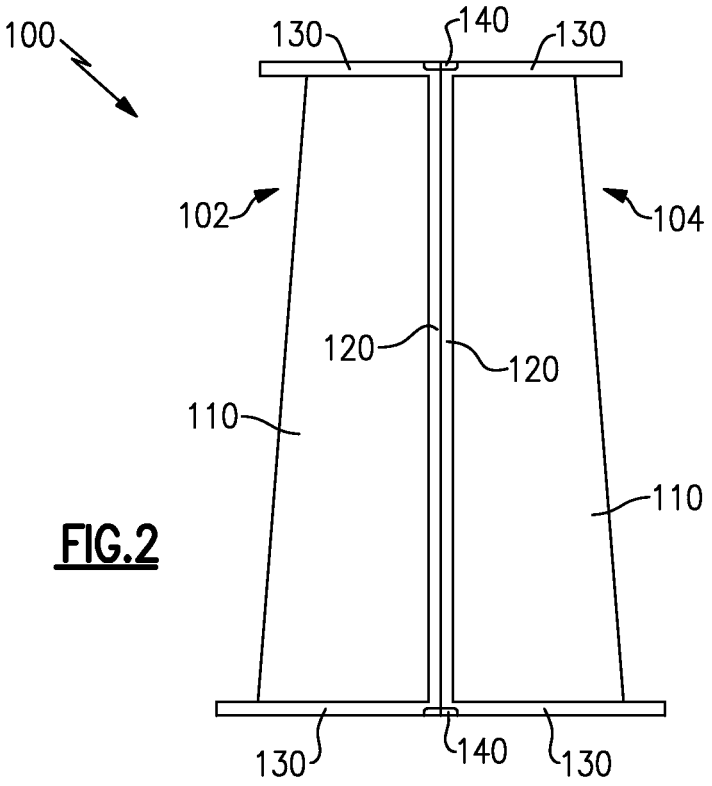
FIG. 2 schematically illustrates a side view of a split case for use in a gas turbine engine, according to an embodiment.

FIG. 2 schematically illustrates a side view of a split case 100 for one of the compressor section 24 or the turbine section 28 of the gas turbine engine 20 illustrated in FIG. 1, according to an embodiment. The split case 100 includes two sections 102, 104 each of which includes a body portion 110, and two axially aligned split flanges 120. While only a single split flange 120 of each section 102, 104 can be seen in the illustrated example of FIG. 2, it is understood that the second split flange 120 is located 180 degrees offset from the first split flange 120, and is hidden in the illustrated view. Each axially aligned split flange 120 is connected to a corresponding split flange 120 of the other section 102, 104 via any known flange connection technique. On each axial end of the split case 100 is a circumferential flange 130. In an assembled gas turbine engine, such as the gas turbine engine 20 of FIG. 1, each of the circumferential flanges 130 is connected to an adjacent structural component, such as a fan case or an adjacent turbine engine split case 100.

Each of the circumferential flanges 130 includes a relief void 140 positioned at the split flanges 120. The relief Void 140 accommodates thermal growth and separation of the split flanges 120 that occurs during operation of the gas turbine engine 20, thereby reducing stresses imparted on an adjacent component by thermal growth of the split case 100.

During operation of the gas turbine engine 20, the split case 100 undergoes heating and cooling, which results in thermal expansion and contraction along the split flange 120. The split flanges 120 are mechanically connected to adjacent split flanges 120, and therefore the split flanges are prevented from completely separating due to the thermal growth. The split flanges 120 are not mechanically connected at the axial ends of each split flange 120 (at the circumferential flanges 130). As a result, the thermal expansion within the split flanges 120 causes a separation at the circumferential flanges 130, and forces a portion of the circumferential flange 130 to protrude axially away from the split case 100.

Incorporation of the relief void 140 in the circumferential flanges 130, prevents the axially protruding portion of the circumferential flanges 130 from contacting an adjacent component connected to the circumferential flange 130 and causing stress on the adjacent component.

Figure 3:
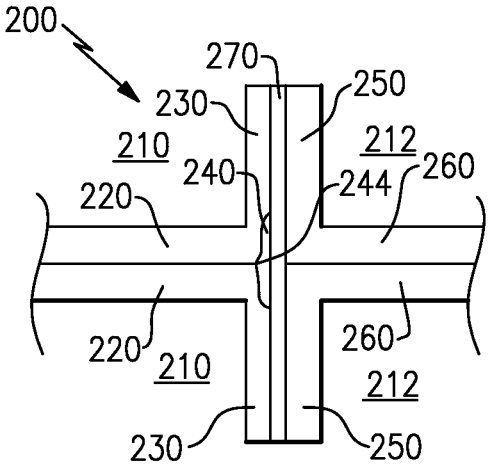
FIG. 3 schematically illustrates a connection between two axially adjacent split cases including a relief void, according to an embodiment.
Figure 4:
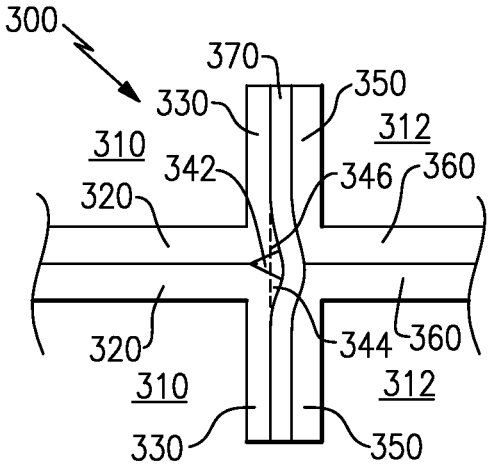
FIG. 4 schematically illustrates a connection between two axially adjacent split cases absent a relief void, according to an embodiment.

With continued reference to FIG. 1, FIG. 4 illustrates the thermal growth of a joint 300 between a split case 310 and a connected case 312. As with the examples of FIGS. 2 and 3, the split case 310 includes split flanges 320 that are connected to each other via any known flange connection arrangement. The split flanges 320 join the circumferential flange 330, and there is no flange connection between the split flanges 320 at the circumferential flange 330.

The illustrated embodiment of FIG. 4 includes an adjacent split case 312 connected to the split case 310 via a connection between circumferential flanges 330, 350. In alternate embodiments, the split case 310 can be connected to any adjacent turbine engine structure including alternate case configurations, an end wall, or any other turbine engine structure and the connection is not limited to a connection between split cases.

During operation of the gas turbine engine 20, the split case 310 heats up, causing thermal growth in the split case 310 as described above. The pulling apart of the split flange 320 is illustrated by a gap 342 between the split flanges 320. The pulling apart at the gap 342 causes an edge 344, or corner, the circumferential flange 330 to protrude axially away from the split case 310. The axial protrusion extends into the circumferential flange 350 of the adjacent case 312 causing deformation or stress at the contact point. A dashed line 346 indicates the position of the edge 344 of the circumferential flange 330 when the split case 310 is not undergoing thermal growth. In the illustrated example of FIG. 4, the protrusion of the edge 344 and the gap 342 between the split flanges 320 is exaggerated for illustrative effect.

With continued reference to FIGS. 1 and 2, and with like numerals indicating like elements, FIG. 3 illustrates a connection 200 between a split case 210 and an adjacent case 212, according to an embodiment. In alternate examples, the split case 210 can be connected to any adjacent turbine engine structure including alternate case configurations, an end wall, or any other turbine engine structure. The split case 210 includes split flanges 220 aligned axially with an axis defined by the split case 210. The split flanges 220 join with a circumferential flange 230 to form a unitary flange structure. Positioned in the circumferential flange 230, at the joint between the split flanges 220 and the circumferential flange 230, is a relief void 240. The relief void 240 is a portion of the circumferential flange 230 that is removed (i.e. a void) to allow for thermal growth of the split case 210 without stressing an adjacent case 212. In some examples, the relief void 240 is a groove.

The circumferential flange 230 of the split case 210 is connected to a circumferential flange 250 of the adjacent case 212 via any known flange connection means. In one example the split case 210 and the adjacent case 212 are connected via bolts, or other fasteners, that protrude through the corresponding circumferential flanges 230, 250. In the illustrated embodiment, the adjacent case 212 is a split case having axially aligned split flanges 260. In alternate embodiments, alternate case styles incorporating a circumferential flange 250 can be used as the adjacent case to the same effect. In yet further embodiments, the circumferential flange 230 of the split case 210 can be connected to any adjacent engine structure, and is not limited to connecting to a flange 250 of an adjacent split case 212.

In the illustrated examples, a third layer 270 is used according to known principles to enhance the connection between the circumferential flanges 230, 250. In alternate embodiments, the third layer 270 may be omitted, or additional layers may be included.

With continued reference to FIGS. 1-3, and with like numerals indicating like elements, Referring again to FIG. 3, a relief void 240 is included in the circumferential flange 230 at the split flange 220 in order to prevent the protrusion of an edge 244 into an adjacent component. When the illustrated split case 210 of FIG. 3 undergoes thermal growth, a gap opens at a joint between the split flanges 220 at an edge 244 illustrated in the example of FIG. 4. The presence of the relief void 240 sets the edge 244 axially away from contact with the adjacent circumferential flange 250 and the third layer 270. As a result, when the split case 210 undergoes thermal growth and the edge 244 protrudes axially away from the split case 210, the edge 244 is prevented from deforming or stressing the adjacent circumferential flange 250 or third layer 270, and stress resulting from the thermal growth is thereby minimized.

Figure 5A:
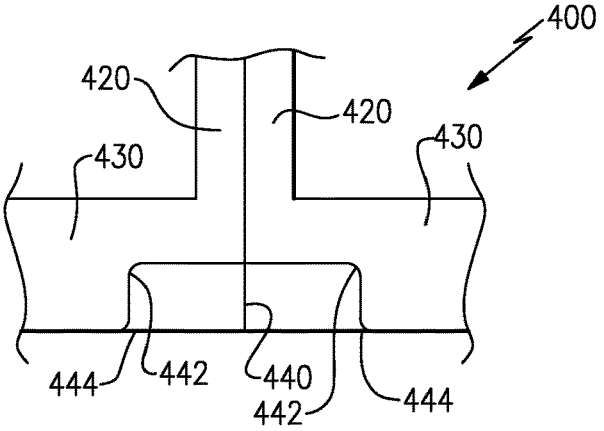
FIG. 5A schematically illustrates a view of the relief void of a split case, such as the split case illustrated in FIG. 2, according to an embodiment.
Figure 5B:
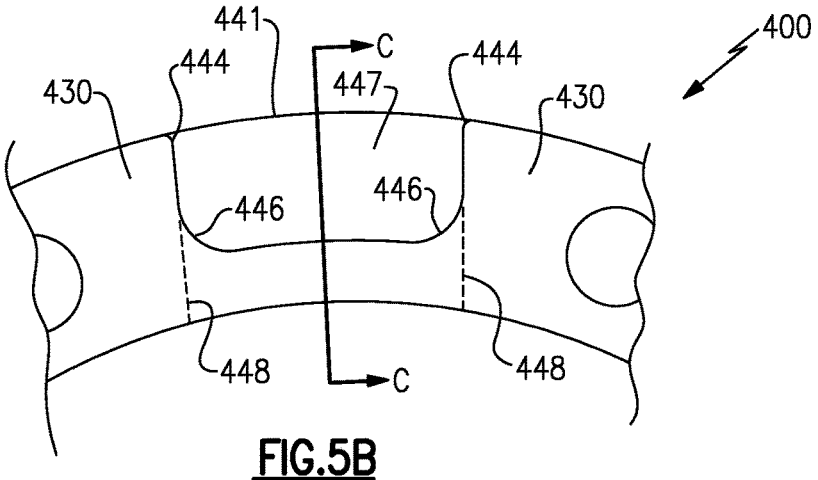
FIG. 5B schematically illustrates an axially aligned view of the relief void of FIG. 5A, according to an embodiment.
Figure 5C:
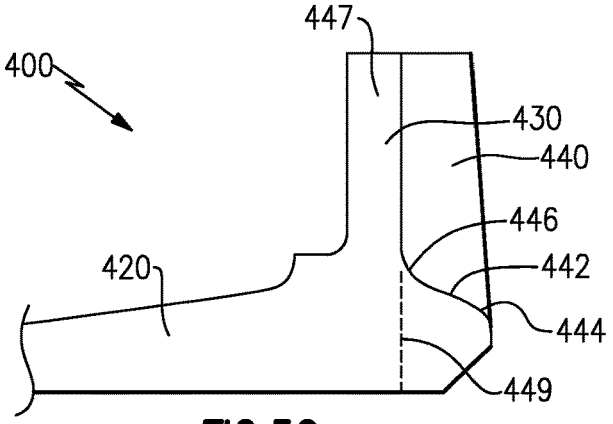
FIG. 5C schematically illustrates a cross sectional view of the relief void of FIG. 5B along view line C, according to an embodiment.

With continued reference to FIGS. 1-4, and with like numerals indicating like elements, FIGS. 5A-5C illustrate a relief void portion 440 of a split case 400 in greater detail.

FIG. 5A provides a radially inward looking external view of the joint between a split flange 420 and the circumferential flange 430 at a relief void 440. The relief void 440 is defined by a groove on an external surface of the circumferential flange 430 at the split flanges 420. The groove is radially aligned and extends inward from a radially outward edge 441 of the circumferential flange 430. In the illustrated example of FIG. 5A, the groove extends a partial radial length of the circumferential flange from a radially outward edge of the circumferential flange. The groove includes an axially inward edge 442. The axially inward edge 442 includes a curvature designed to allow the axially inward edge 442 to flex during thermal growth without causing elastic deformation of the edge 442.

The groove further includes an axially outer edge 444. The illustrated axially outer edge 444 includes a small curvature to allow a gap to form without forcing the axially outer edge 444 to protrude into an adjacent structure. In alternate examples, the axially outer edge 444 can be a chamfered edge instead of a curve and achieve a similar function.

FIG. 5B illustrates an axially aligned view of the circumferential flange 430 of FIG. 5A. The view of FIG. 5B shows an axially aligned edge 446 of the groove defining the relief void 440. The axially aligned edge 446 is curved similar to the axially inward edge 442, and achieves the same function. The groove defined by the relief void 440 extends only partially into the circumferential flange 430 along the axis defined by the split flange case, thereby defining a back portion 447 of the groove.

In an alternate example, the axially aligned edge 446 can be chamfered instead of curved. In yet a further alternate example, the groove defining the relief void 440 can be extended along the dashed lines 448 to be the full radial length of the circumferential flange 430.

FIG. 5C illustrates a cross sectional view of the circumferential flange 430 and the split flange 420 of FIG. 5B along view line C. The split flange 420 connects to the circumferential flange 430 as illustrated in FIGS. 2-4. The groove defining the relief void 440 includes a solid backing wall 447 that prevents the groove from breaking the circumferential flange. The radially inward edge 442 of the circumferential flange in the illustrated example connects the curve axially aligned edge 446 to the axially outer edge 444. In alternate examples. The radially inward edge 442 can be a chamfered void instead of the curved void illustrated and achieve the same effect.

As described above, in some examples the groove defined by the relief void 440 can extend the full radial length of the circumferential flange along the dashed line 449. In this alternate example, the edges 446, 442 and 44 are omitted.

While the above described split case 100, 210, 310 is described with regards to a split case having two case sections, one of skill in the art having the benefit of this disclosure would understand that the principles described can be applied to a split case having three or more case sections and are not limited to a two section design. Furthermore, one of skill in the art would understand that the bodies 110 of the case sections (see FIG. 2) could include additional features not illustrated in order to accommodate the contained gas turbine engine components, and still fall within the above disclosure.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A split case for a gas turbine engine comprising:

a plurality of split case portions defining a turbine engine case section;

each of said split case portions in said plurality of split case portions including a first split flange and a second split flange, wherein each of said first split flange and said second split flange are axially aligned;

each of said first split flange and said second split flange is configured to mechanically connect to another split case portion in said plurality of split case portions defining said turbine engine case section; each of said split case portions in said plurality of split case portions including a circumferential flange portion located at an axial end, wherein the circumferential flange portion is configured to connect the turbine engine case section to an adjacent turbine engine component; and each of said circumferential flanges including a thermal expansion relief void positioned at said split flanges.

2. The split case of claim 1, wherein each of said relief voids extends partially into said circumferential flange, such that a radially aligned groove in said circumferential flange is defined.

3. The split case of claim 2, wherein said radially aligned groove extends a full radial length of said circumferential flange.

4. The split case of claim 2, wherein said radially aligned groove extends a partial radial length of the circumferential flange from a radially outward edge of the circumferential flange thereby defining a radially inward wall of the relief void.

5. The split case of claim 4, wherein said radially inward wall of the relief void comprises an axially inward edge connected to a back portion of the circumferential flange, and an axially outward edge connected to an axial end of the circumferential flange.

6. The split case of claim 5, wherein said axially inward edge comprises a curvature.

7. The split case of claim 5, wherein said axially outward edge comprises a curvature.

8. The split case of claim 5, wherein said axially inward edge comprises a chamfer.

9. The split case of claim 5, wherein said axially outward edge comprises a chamfer.

10. The split case of claim 1, wherein each of said circumferential flanges extends radially outward from an axial end of the corresponding split case.

11. The split case of claim 1, wherein each of said circumferential flanges extends along an arc of the corresponding axial end.

12. A gas turbine engine comprising:

a split case structure configured to circumferentially surround at least a portion of said gas turbine engine, the split case structure further comprising:

a plurality of split case portions defining the split case structure;

each of said split case portions in said plurality of split case portions including a first split flange and a second split flange, wherein each of said first split flange and said second split flange are axially aligned;

each of said first split flange and said second split flange is configured to mechanically connect to another of said plurality of split case portions in said plurality of split case portions defining said split case structure;

each of said split case portions in said plurality of split case portions including a circumferential flange portion located at an axial end, wherein the circumferential flange portion is configured to connect the turbine engine case section to an adjacent turbine engine component; and each of said circumferential flanges including a thermal expansion relief void positioned at said split flanges.

13. The gas turbine engine of claim 12, further comprising at least a second case structure wherein said split case structure is mechanically connected to said second case structure via said circumferential flanges.

14. The gas turbine engine of claim 13, further comprising a material layer connecting said circumferential flanges to a circumferential flange of said second case structure.

15. The gas turbine engine of claim 13, wherein each of said relief voids is configured to reduce deflection in said second case structure due to thermal expansion of said split case structure.

16. The gas turbine engine of claim 13, wherein each of said relief voids extends partially into said circumferential flange, such that a radially aligned groove in said circumferential flange is defined.

17. The gas turbine engine of claim 16, wherein said radially aligned groove extends an entire radial length of said circumferential flange.

18. The gas turbine engine of claim 16, wherein said radially aligned groove extends a partial radial length of the circumferential flange from a radially outward edge of the circumferential flange thereby defining a radially inward wall of the relief void.

19. The gas turbine engine of claim 18, wherein said radially inward wall of the relief void comprises an axially inward edge connected a back portion of the circumferential flange, and an axially outward edge connected to an axial end of the split case portion.

* * * * *